US007908782B1

(12) United States Patent
LaRue

(10) Patent No.: US 7,908,782 B1
(45) Date of Patent: Mar. 22, 2011

(54) PIVOT MOUNT FOR FIREARM SIGHTING DEVICES

(76) Inventor: Mark C. LaRue, Leander, TX (US)

( * ) Notice: Subject to any disclaimer, the term of this patent is extended or adjusted under 35 U.S.C. 154(b) by 446 days.

(21) Appl. No.: 12/082,608

(22) Filed: Apr. 12, 2008

(51) Int. Cl.
*F41G 1/387* (2006.01)

(52) U.S. Cl. ..... 42/128; 42/124

(58) Field of Classification Search ..... 42/124, 42/125, 126, 127, 128
See application file for complete search history.

(56) References Cited

U.S. PATENT DOCUMENTS

| | | | | | |
|---|---|---|---|---|---|
| 2,367,762 | A | | 1/1945 | Eiane | |
| 2,527,289 | A | * | 10/1950 | Allen | 42/128 |
| 2,529,801 | A | * | 11/1950 | Fisk | 42/128 |
| 2,629,175 | A | * | 2/1953 | Merritt | 42/128 |
| 2,639,507 | A | | 5/1953 | Pachmayr | |
| 2,644,237 | A | | 7/1953 | Pachmayr | |
| 2,710,453 | A | * | 6/1955 | Beverly | 42/128 |
| 2,803,880 | A | | 8/1957 | Weaver | |
| 3,178,823 | A | * | 4/1965 | Lipski | 42/126 |
| 4,092,793 | A | | 6/1978 | Ricks | |
| 4,092,899 | A | | 6/1978 | Lienau | |
| 4,461,087 | A | * | 7/1984 | Norman | 42/128 |
| 6,026,580 | A | | 2/2000 | LaRue | |
| 6,705,037 | B2 | | 3/2004 | Van Kirk | |
| 7,272,904 | B2 | | 9/2007 | LaRue | |
| 7,367,152 | B2 | * | 5/2008 | Samson | 42/128 |
| 7,730,655 | B2 | * | 6/2010 | Spuhr | 42/127 |
| 2006/0123686 | A1 | * | 6/2006 | Larue | 42/127 |
| 2006/0162227 | A1 | | 7/2006 | Samson | |

* cited by examiner

*Primary Examiner* — Benjamin P Lee
(74) *Attorney, Agent, or Firm* — James L. Jackson

(57) ABSTRACT

A pivot mount base is assembled to or removed from the sight mounting rail of a firearm by a lever actuated cam energized rail clamping mechanism. The pivot mount base supports and provides for rotational and linear movement of a pivot shaft. A pivot shaft locator pin extending transversely through the pivot shaft is adapted to be selectively received in position controlling relation by pairs of aligned shaft location receptacles defined by the pivot mount base. A sight support device is fixed to the pivot shaft and serves to retain a firearm sighting device. The sight support device and sighting device are moveable between an operative position where the sighting device can be used to sight the firearm on a target and an inoperative position where the sighting device is positioned laterally offset from its operative position. The sight support device is pivotally mounted by the pivot shaft and is spring energized to secure the sighting device against inadvertent movement and noise at its operative and inoperative positions.

16 Claims, 6 Drawing Sheets

PIVOT MOUNT FOR FIREARM SIGHTING DEVICES

BACKGROUND OF THE INVENTION

1. Field of the Invention

The present invention relates generally to firearms and more particularly to firearm sighting devices. Even more specifically the present invention concerns a pivot mount by which a particular firearm sighting device, such as an optical or laser sighting device is releasably mounted to the sight mounting rail of a tactical firearm by a locking lever operated clamp mechanism and, when so mounted, a sight support portion of the mount is pivotally moveable between an operative position at which the sighting device is useable for the purpose of sighting on a target and an inoperative position at which the sighting device is positioned out of the normal line of sight of the firearm. The present invention also concerns a pivot mount for a firearm sighting device or other firearm related implement that is adapted for manual unlocking and pivotal movement, without necessitating the use of any tools or other equipment.

2. Description of the Prior Art

Virtually all firearms are provided with mechanical sighting devices, many of which are selectively adjustable by the user to accomplish bullet strike as nearly as possible to a point of aim. Firearms, particularly rifles, have for a considerable period of time been provided with mechanical sights, typically referred to as "iron sights", and with additional sighting devices, such as telescopes and other optical sighting devices. At times, if the mechanical sighting device cannot be readily used with an optical sighting device in place, it is desirable to remove the optical sighting device from the firearm. Typically, removal of an optical sighting device from a firearm requires the use of certain tools and equipment and the risk of losing sight mounting or adjusting parts if such an activity is carried out in a field environment. Moreover, removal of a sighting device from a firearm inevitably results in the loss of zero, thus requiring the firearm to be again sighted in after the sighting device has been re-installed on the firearm. For these reasons, telescope sighting devices and sight mounts have been developed to permit hinged or pivotal movement of a telescope from an operative sighting position to a laterally off-set inoperative position. These improvements enable a telescope to be swung to and from a sighting position on a firearm without requiring re-adjustment of the sight. U.S. Pat. Nos. 2,639,507 and 2,644,237 of Pachmayr and 2,803,880 of Weaver are representative of pivotally mounted telescopes of this nature.

More recently, especially in the tactical firearm environment various firearm sighting devices are often mounted on firearms in tandem so that the cumulative benefit of dual sighting devices enhances the character of firearm use. For example, an optical sighting device and a thermal or night vision sighting device can be used in tandem to provide the user with the capability for using optical sighting during conditions of poor light. Laser sighting devices are used in conjunction with telescope sights to provide the user with the benefits of a magnified image of a target and with laser sighting of the target. At times it is beneficial to eliminate a sighting device from the line of sight, but to do so ordinarily requires the use of tools or other equipment. In the tactical environment, military or law enforcement personnel do not ordinarily have sufficient available time for sight removal or installation, so the need for changes of sighting devices has largely remained unsatisfied.

Even more recently tactical personnel have been provided with the capability for efficient release and removal of an optical sighting device from a firearm having a mounting rail and re-installing the sighting device precisely to its previous zero condition. U.S. Pat. No. 7,272,904 of Mark C. LaRue concerns an adjustable locking lever operated Picatinny rail clamp mechanism providing this sight removal and replacement capability while maintaining a previously established zero.

There is a current need, especially in the field of tactical firearms, to provide a mounting device for optical sighting devices and other sight related devices that have a pivotal capability for movement of sighting devices between operative and inoperative positions without requiring the use of tools or equipment of any nature. Especially in the tactical environment is desirable to provide a pivotal optical sight mount that secures an optical sight device against inadvertent movement even when the sighting device has been moved to its inoperative position. It is also desirable to provide a pivot mount that can be easily and quickly removed from a firearm together with its optical sighting device, transported to a site for use, and then re-installed on the firearm in sight zero condition, so that the firearm can be used immediately for precision firing.

SUMMARY OF THE INVENTION

It is a principal feature of the present invention to provide a novel pivot mount mechanism for optical sighting devices and other sight related implements that permits the user of a firearm to manually release the pivot mount from its operative position and rotate the pivot mount to an inoperative sight position without any requirement for the use of tools or other equipment.

It is another feature of the present invention to provide a novel pivotal firearm sight mount mechanism that stabilizes a sight mount and its sighting device at both the operative and inoperative positions of the sighting device to prevent any inadvertent movement or noise of the sighting device as the firearm is handled.

It is also a feature of the present invention to provide a novel pivotal firearm sight mount mechanism that is incorporated with a lever actuated sight rail clamping mechanism, thus permitting the entire pivot mount mechanism to be removed from a firearm and replaced without losing the previously sighted zero of the sighting mechanism.

It is an even further feature of the present invention to provide a novel pivotal firearm sight mount mechanism that is selectively moveable between operative and inoperative positions relative to a firearm without any requirement for the use of tools or special equipment to permit such movement.

Briefly, the various objects and features of the present invention are realized by providing a pivot mount base that is assembled to or removed from the sight mounting rail of a firearm by a lever actuated cam energized rail clamping mechanism. The pivot mount base is provided with spaced upstanding bosses that provide for rotational and linear movement of a pivot shaft that is located within shaft passages of the bosses. A pivot shaft locator pin extending transversely through the pivot shaft is adapted to be received in selective position controlling relation by pairs of aligned shaft location receptacles defined by one of the bosses or by other structure of the mount base. A sight support device is fixed to and rotates along with the pivot shaft and serves to retain a firearm sighting device, such as a telescope, for example. The sight support device and sighting device are pivotally moveable about the center-line of the pivot shaft between an operative position where the sighting device can be used to sight the firearm on a target and an inoperative position where the sighting device is positioned laterally offset from its operative position. The sight support device, in addition to being mounted in fixed relation with the pivot shaft, is spring energized along with the pivot shaft to secure the sighting device in forcible contact with position controlling surfaces of the mount and thus secure the sighting device against inadvertent movement and noise at both its operative and inoperative positions.

BRIEF DESCRIPTION OF THE DRAWINGS

So that the manner in which the above recited features, advantages and objects of the present invention are attained and can be understood in detail, a more particular description of the invention, briefly summarized above, may be had by reference to the preferred embodiment thereof which is illustrated in the appended drawings, which drawings are incorporated as a part hereof.

It is to be noted however, that the appended drawings illustrate only a typical embodiment of this invention and are therefore not to be considered limiting of its scope, for the invention may admit to other equally effective embodiments. In the Drawings.

DETAILED DESCRIPTION OF PREFERRED EMBODIMENT

Figure 1:
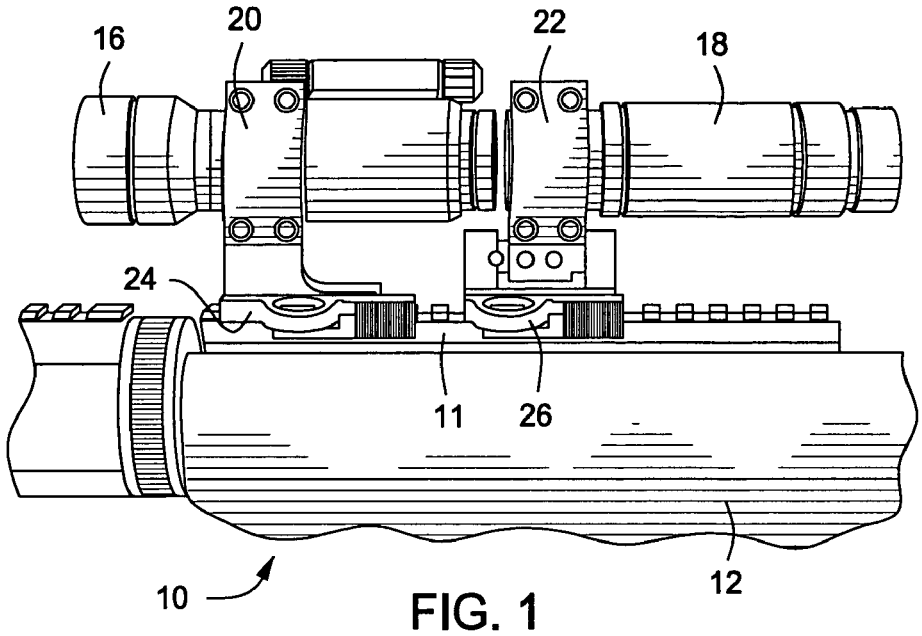
FIG. 1 is an elevational view showing the receiver part of a tactical firearm and showing two sighting devices mounted to the Picatinny rail of the firearm, with one of the sight mounting mechanisms being a pivot mount embodying the principles of the present invention.

Referring now to the drawings and first to the elevational view of FIG. 1, there is shown a portion of a tactical firearm generally at 10 having a Picatinny or other sight mounting rail 11 fixed to or integral with the receiver 12 of the firearm. The sight mounting rail 11 defines upwardly facing angulated clamping support surfaces and downwardly facing angulated clamping surfaces as will be explained in detail below. A pair of sighting devices 16 and 18 are positioned in tandem or series on the firearm, being supported and positioned by sight support members 20 and 22 that are in turn supported and positioned on the firearm by lever actuated sight mount rail clamp mechanisms 24 and 26. The lever actuated sight mount rail clamp mechanism shown generally at 26 in FIG. 2 has a mounting base structure 28 that is constructed essentially according to the teachings of U.S. Pat. No. 7,272,904 of LaRue, which patent is incorporated herein by reference for all purposes. A base location key 29 projects downwardly from the under side of the mounting base 28 and extends into a selected key slot of the Picatinny or other sight mounting rail for selected location of the mounting base and its sighting device with respect to the rail. It should be borne in mind that the sight mounting base structure 28 may be of a form that is mounted directly to the receiver of a firearm if it is not desired to provide for removal and replacement of sighting devices without loss of sighting zero. Non-tactical permanently mounted sighting devices of this nature can be efficiently used in the recreational shooting environment to permit selective movement of a telescope or other sighting device between operative and inoperative positions to facilitate use of the iron sights of the firearm.

Figure 8:
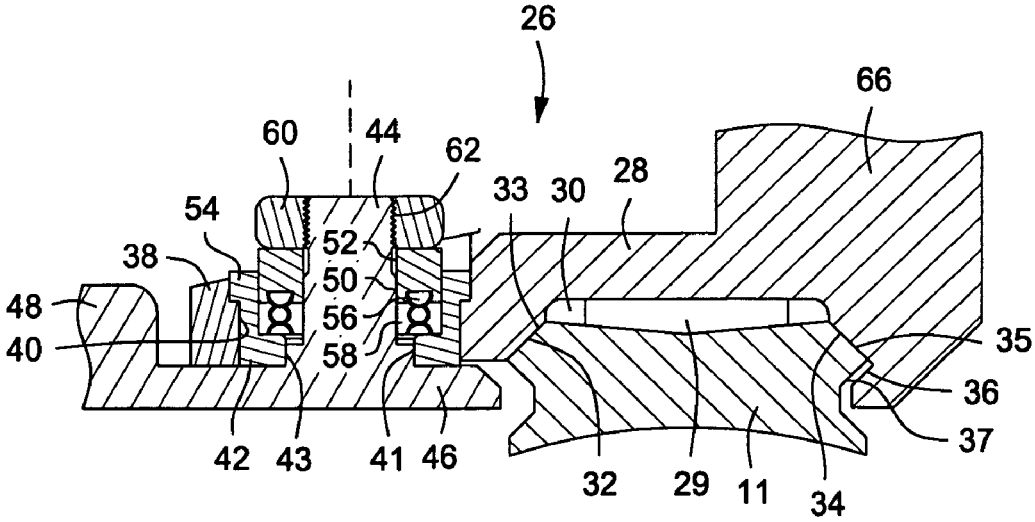
FIG. 8 is a partial sectional view taken along line 8-8 of FIG. 5 and showing the detailed construction of the lever actuated mounting base locking mechanism.

The mounting base 28 is configured to define a rail receiving receptacle 30 with spaced, downwardly and oppositely angulated surfaces 32 and 34 which are oriented for contact with correspondingly angulated upwardly facing support surfaces 33 and 35 of the rail 11. The mounting base 28 also defines an upwardly facing angulated surface 36 that is positioned for retaining engagement with a correspondingly angulated clamping surface 37 of the rail 11. A locking platform 38 is integral with and extends laterally from the mounting base 28 and defines an opening 40 within which is seated an annular insert 42 as shown in FIG. 8. The annular insert is composed of a suitable hard, wear and impact resistant metal material such as steel, stainless steel, titanium alloy or any suitable non-metal material having wear and impact resistance. The annular insert 42 defines a central opening 41 that receives an upwardly projecting circular shoulder 43 of a spline/spindle shaft or post 44 in rotatable relation therein.

Figure 5:
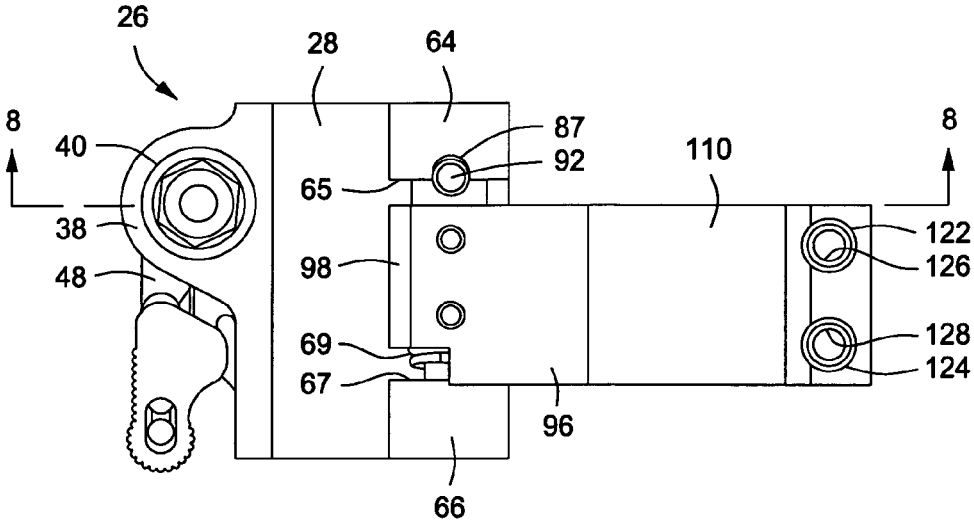
FIG. 5 is a plan view of the pivot mount mechanism of FIGS. 1-4, showing the laterally offset inoperative position of the sight support device.
Figure 6:
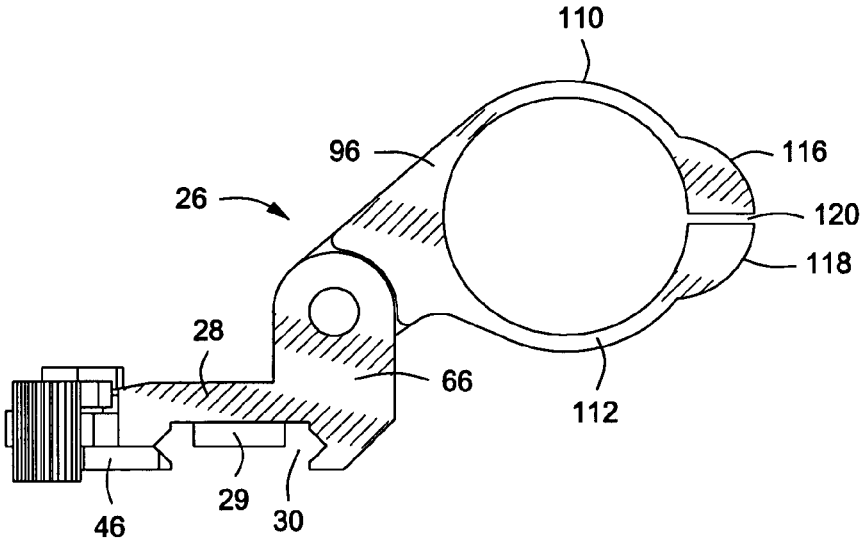
FIG. 6 is an end view of the pivot mount mechanism of FIG. 4, showing the laterally offset inoperative position of the sight support device.
Figure 7:
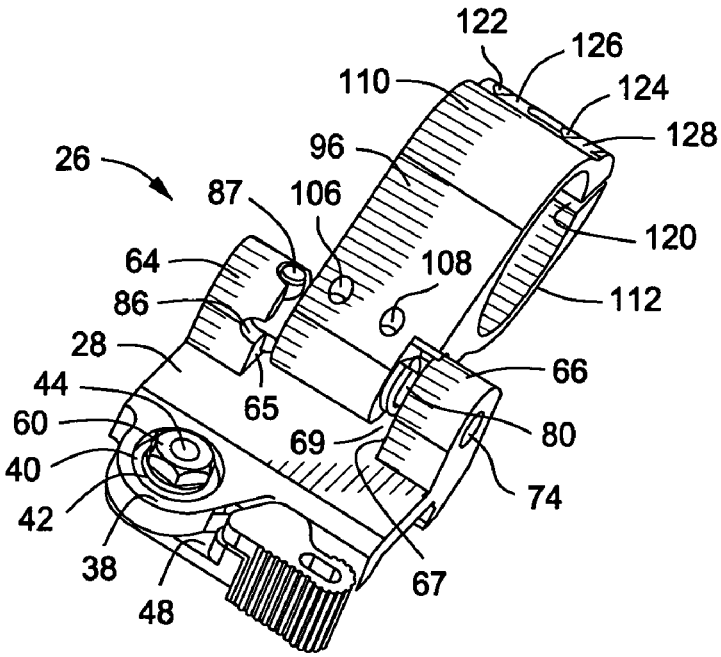
FIG. 7 is an isometric illustration of the pivot mount mechanism of FIGS. 5 and 6, also showing the inoperative, i.e., laterally offset position of the sight support device.

The spline/spindle shaft 44 is integral with and projects upwardly from a manually rotated cam plate 46 of a locking lever structure 48 as shown in FIGS. 5, 7 and 8. The manually rotated locking lever structure 48 of each sight mount assembly 24 and 26 is manipulated, i.e., rotated, for locking and unlocking of the sight mounting bases 24 and 26 from the sight mounting rail 11 when it is desired to remove and replace either of the optical sighting devices 20 and 22. Especially when the sighting device is being used on firearms during tactical activities, this feature permits the sighting devices and the mounts thereof to be removed from a firearm and carried in protective fashion, such as in a pocket of a personnel pack, and when its use is needed the user will simply and quickly clamp the sighting device to the rail device 11 of the firearm, with the sighting device being accurately positioned at its pre-set sighting position or zero. This feature permits a sighting device to be unlocked, removed and re-assembled and locked in place without losing its preset aim point or zero.

The spline/spindle shaft 44 defines a shaft section 50 of non-circular cross-sectional configuration that is received within a corresponding non-circular opening 52 of a circular drive member 54, thus establishing a linearly moveable but non-rotatable relation of the circular drive member with respect to the spline/spindle shaft 44. A compression spring member 56 is located within a circular spring receptacle or pocket 58 and establishes spring force transmitting relation with the circular drive member. The compression spring maintains the circular drive member 54 in force transmitting relation with an adjustment nut member 60 that is threaded to an outer threaded section 62 of the spline/spindle shaft 44. This feature accomplishes synchronous rotation of the shaft 44, circular drive member 54 and adjustment nut 60 and, since there is no relative rotation of components, overcomes any tendency for loosening or tightening of the adjustment nut when the shaft 44 is rotated by the locking lever 48. The adjustment nut is rotatably adjusted with a simple hex wrench by the user of the firearm to achieve desired clamping force of the lever actuated clamp mechanism. Such adjustment ensures that the sight mount and thus the sighting device is retained to the Picatinny rail with optimum force causing the sighting device to assume its previous zero with precision when assembled and locked at its previous location on the Picatinny rail.

As mentioned above, it is desirable at times to eliminate one of the sighting devices, such as the sighting device 18, from the line of sight of the user of the firearm. It has been found practical to establish pivotal mounting for a sighting device so that it can be pivoted from an operative position for sighting on a target to an inoperative position, out of the line of sight of the user, so that another mechanical or optical sighting device can be used exclusively for firearm sighting. It is also desirable, when a sighting device has been pivotally moved to an inoperative position, to ensure that the sighting device and its mounting mechanism do not move inadvertently as the firearm is moved and does not make noise when the firearm is handled. This feature is especially important in the use of firearms during tactical operations where inadvertent movement of any component of a firearm or any noise resulting from such movement can result in a disadvantage to the user or other personnel in association with the user.

Figure 2:
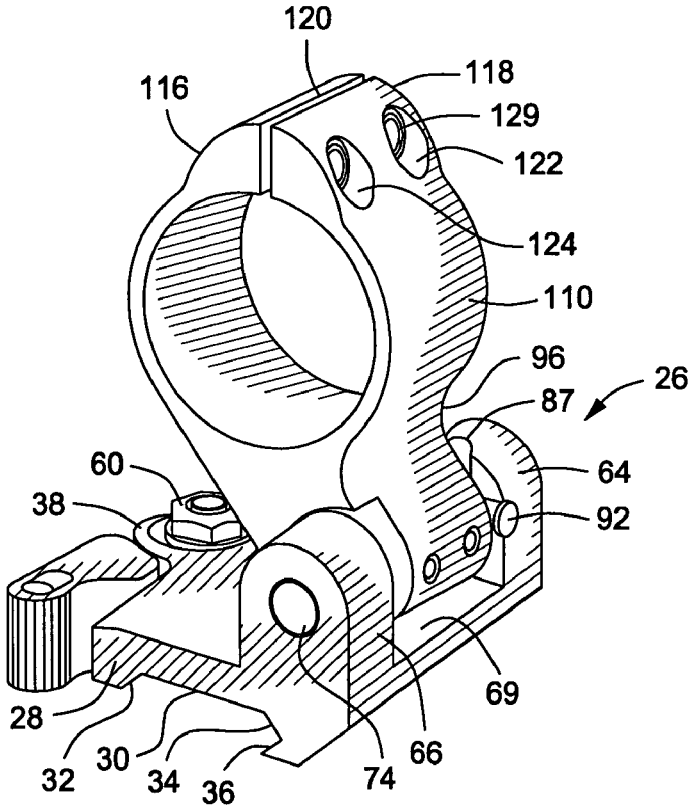
FIG. 2 is an isometric illustration of the pivot mount mechanism of FIG. 1, showing the operative position of the sight support device thereof.
Figure 3:
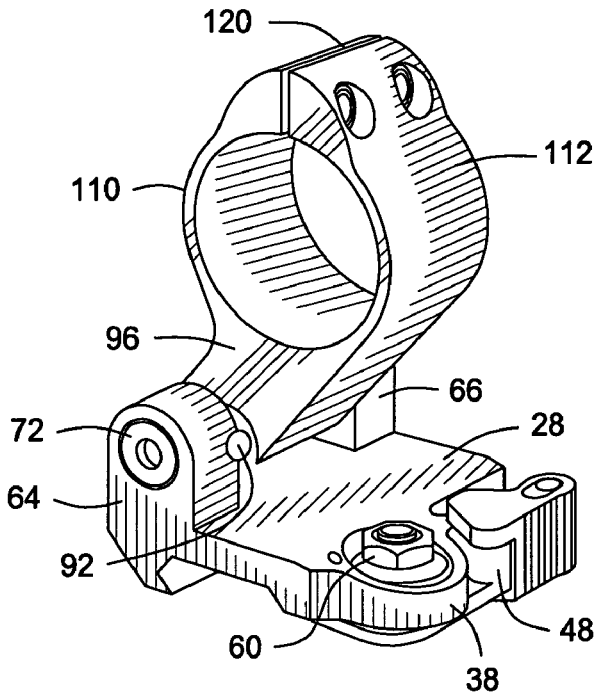
FIG. 3 is another isometric illustration of the pivot mount mechanism of FIGS. 1 and 2, showing the operative position of the sight support device thereof from another point of view.
Figure 4:
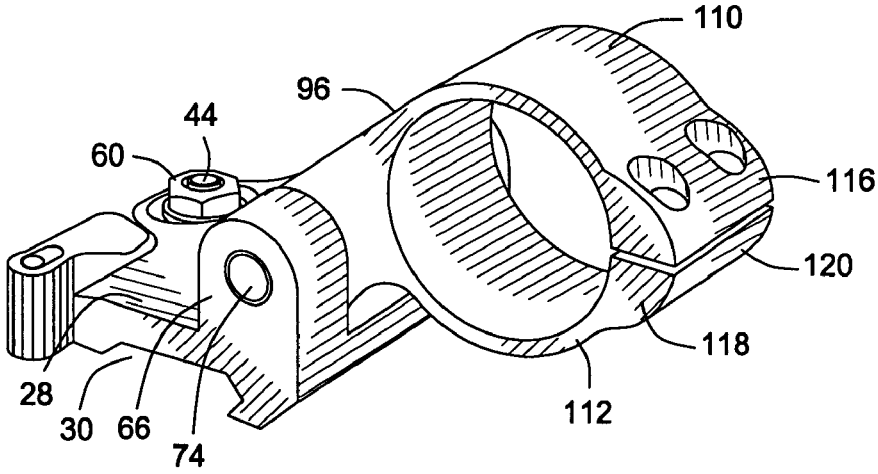
FIG. 4 is an isometric illustration of the pivot mount mechanism of FIGS. 1-3, showing the inoperative, i.e., laterally offset position of the sight support device thereof.
Figure 11:
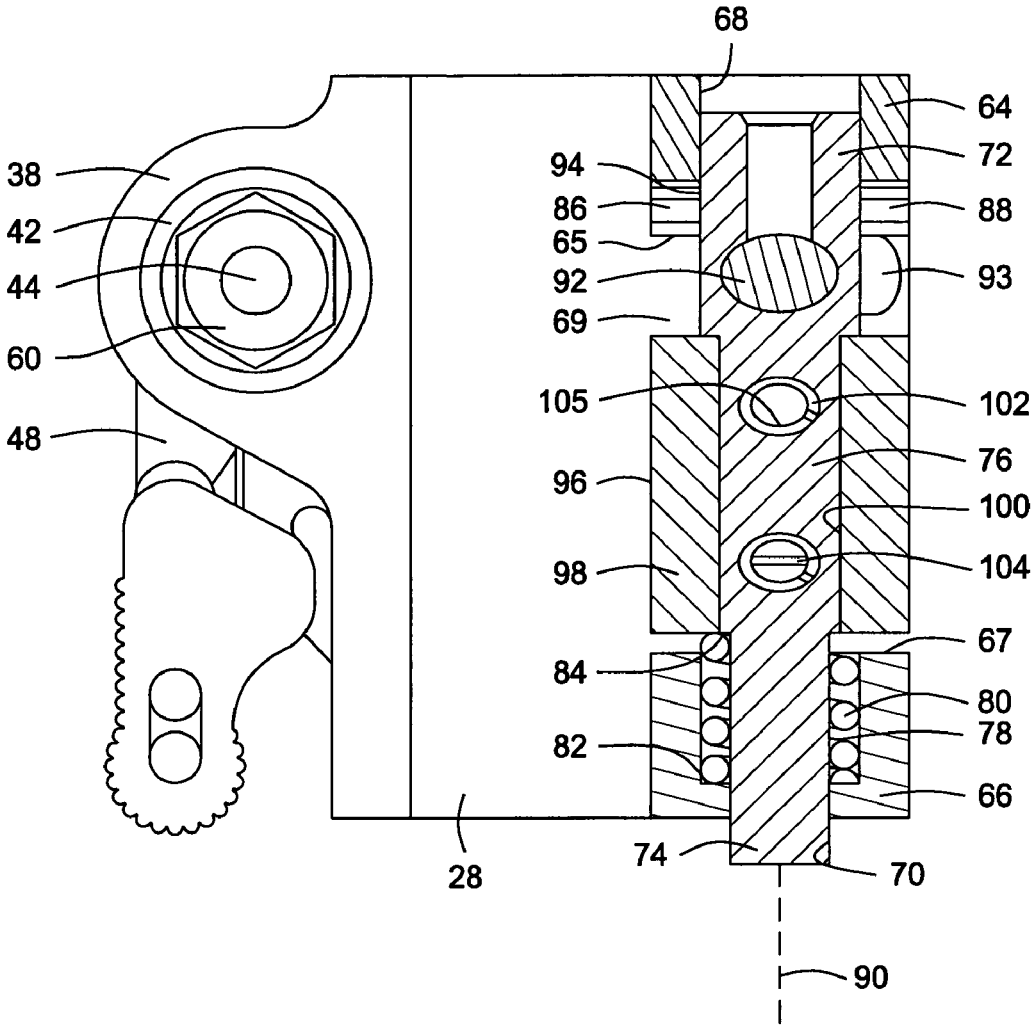
FIG. 11 is a sectional view taken along line 11-11 of FIG. 10 and showing the pivot mount base and its sight support positioning control mechanism in detail.

As shown in the sectional view of FIG. 11 and also in FIGS. 2 and 4, a pair of spaced upstanding pivot bosses 64 and 66 project upwardly from the mounting base 28 and are machined to define transverse bores 68 and 70 through which extend end portions 72 and 74 of a rotatable pivot shaft 76. Conversely, an upwardly projection portion of a mounting base can be machined to define a slot, with a pivot shaft rotatably mounted to portions of the mounting base and extending across the slot. The pivot bosses 64 and 66 define opposed inner end surfaces 65 and 67 that define a space or slot 69 therebetween. The boss 66 defines an enlarged passage section forming an annular spring chamber 78 within which a portion of a compression spring 80 is located. The compression spring bears against a circular internal shoulder 82 within the boss 66 and also bears against an annular shoulder 84 of the pivot shaft 76 and may also bear against an axial end portion of a sight support member. Thus, the pivot shaft is urged in one linear direction, toward the boss 64 by the force of the compression spring 80. The space or slot 69 is sufficiently wide to permit manually energized axial movement of the sight support member as will be explained in detail below.

As is evident from FIGS. 2, 5, 7, 9 and 11, the pivot boss 64 is machined to define a first pair of pivot shaft location receptacles 86 and 88 which are generally horizontally aligned and intersect the center-line 90 of the rotatable pivot shaft 76. The location and orientation of the first pair of pivot shaft location receptacles establish the operative or sighting position of the sighting device 18. The pivot boss 64 is also machined to define a second pair of generally vertically aligned pivot shaft location receptacles 87 and 89 that are preferably oriented in substantially 90° angular relation with respect to the first pair of pivot shaft location receptacles 86 and 88. It should be borne in mind, however, that the second pair of generally vertically aligned pivot shaft location receptacles 87 and 89 establish a laterally offset inoperative position of the sighting device 18 and thus need not be precisely located in 90° angular relation with the first pair of pivot shaft location receptacles. It is only important that the sighting device be moved to a selected lateral position with respect to the line of firearm sighting where it will be located as desired by the firearm user for efficient and effective use of the remaining sighting device.

It is desirable to provide a suitable means for establishing at least one operational rotational position of the pivot shaft for selective positioning of the sighting device 18 at an operative position for precision sighting of the firearm on a target. This feature can be accomplished by establishing pivot shaft location surfaces on the pivot mount, which surfaces are engaged by one or more corresponding shaft rotation location surfaces or members that are integral with or fixed to the pivot shaft. According to the preferred embodiment of the present invention, a pivot shaft locator pin 92 is fixed within a transverse bore of the pivot shaft 76 and has end portions 91 and 93 projecting beyond the cylindrical outer surface 94 of the end portion 72 of the pivot shaft 76. The pivot shaft locator pin 92 is preferably of cylindrical configuration and is composed of hardened wear resistant material such as steel. The end portions 91 and 93 of the pin are positioned for selective engagement within substantially 90° offset first and second pairs of the pivot shaft location receptacles of the upstanding boss 64 of the mount base 28. Each of the pivot shaft location receptacles is in the form of a depression closely approximating the dimension and geometry of the pivot shaft locator member 92, but the location receptacles are designed to provide for precision location of the pin 92 with respect to the mount base. The receptacles are of slightly oblong configuration as compared with the circular cross-sectional configuration of the end portions 91 and 93 of the locator pin, thereby defining centering surfaces on each side of each receptacle. These centering surfaces guide the pivot shaft locator pin 92 precisely to a predetermined position establishing the pre-set zero condition of the sight mechanism. Each of the pivot shaft location receptacles define opposed pin centering surfaces that ensure precise rotational positioning of the pivot shaft locator pin 92 with respect to the upstanding boss 64. The receptacles are preferably relieved in depth so that the pivot pin engages the receptacle surfaces at opposed side portions thereof which serve to guide the pin to its precisely centered position within the receptacle. This feature ensures precise positioning of the sighting device at the operative position of the pivot mount mechanism when the sighting device is pivotally returned to its operative position. This feature ensures precision positioning of the pivot shaft with respect to at least the first pair of pivot shaft location receptacles 86 and 88 to establish the precision sighting position of the pivot shaft, sight support and the sighting device that is controlled by rotation of the pivot shaft. With the pivot shaft locator pin 92 located within either selected pair of pivot shaft location receptacles rotation of the pivot shaft is restrained against inadvertent rotational movement. This feature ensures that the sighting device and its support will be substantially immovable at both its operative and inoperative positions. When the sighting device is located at its laterally offset inoperative position, it will be secured by the pivot mount against any inadvertent movement and thus will not move about or tend to create any noise. This is an important feature promoting the tactical application of the pivotal sight positioning mechanism.

To permit pivot shaft rotation the pivot shaft 76 is moved linearly within the bores 68 and 70 of the upstanding pivot bosses 64 and 66 sufficiently to disengage the ends 91 and 93 of the pivot shaft locator pin 92 from an aligned pair of pivot shaft location receptacles and move the ends of the pivot shaft locator pin beyond the inner end surface 65 of the upstanding pivot boss 64. At this point the pivot shaft 76 is free for rotation, though under the influence of the compression spring 80, and may be rotated through an increment of at least 90°. Linear movement of the pivot shaft is caused by application of manual force against the force of the compression spring 80 as is explained in greater detail below. When this manual force is released the compression spring will tend to move the pivot shaft toward the pivot boss 64. When the ends 91 and 93 of the pivot shaft locator pin 92 are in registry with either pair of pivot shaft location receptacles and the manual force overcoming the spring force has been relieved, the force of the compression spring 80 will move the pivot shaft linearly and seat the ends of the pivot shaft locator pin within the pivot shaft location receptacles, preventing rotation of the pivot shaft. Depending on the position of the locator pin ends with respect to the pivot shaft location receptacles, the spring force may cause the locator pin ends to engage the boss surface 65. When the locator pin ends are in engagement with the surface 65 the sight support member 96 and its sight device can be manually rotated until the ends of the pin are forced by the compression spring to enter into a selected pair of locator receptacles and secure the mechanism against inadvertent rotation.

A sight support device 96 defines pivot section 98 and is located within the space or slot 69 between the pivot boss surfaces 65 and 67. The sight support device is of smaller axial dimension as compared to the dimension of the space or slot between the pivot boss surfaces 65 and 67, thereby permitting linear movement of the sight support device within the space, such linear movement being sufficient to extract the ends 91 and 93 of the pivot shaft locator pin 92 from the pivot shaft locator receptacles to permit shaft and sight support device rotation. The sight support device 96 defines a bore 100 shown in the sectional view of FIG. 11 through which the pivot shaft 76 extends and within which the sight support device is secured against movement.

It is necessary for optimum sighting accuracy of the firearm that the sight support device 96 be disposed in fixed relation with the pivot shaft. One suitable means for accomplishing this requirement takes the form of roll pins 102 and 104 that are positioned within transverse bores 106 and 108 of the sight support device 96 and extend in close fitting relation through holes 105 of the pivot shaft 76. Another means for accomplishing this requirement may take the form of a splined retention mechanism. Any other system for securing the sight support device 96 in substantially fixed relation with the pivot shaft may be employed within the spirit and scope of the present invention.

The sight support device 96 defines ring sections 110 and 112 that define a generally cylindrical opening 114 that is sized to fit closely with the cylindrical barrel portion of a sighting device such as shown at 18 in FIG. 1. Each of the ring sections defines an enlargement 116 and 118 which, in absence of retainer forces drawing them together, defines a gap 120. The enlargements 116 and 118 are machined to define openings 122 and 124 within which are located hardened internally threaded inserts 126 and 128. Screws 129 or other suitable retainer devices are received within the inserts and are tightened to draw the enlargements toward one another and develop a clamping activity establishing sufficient frictional gripping relation to secure the sighting device against inadvertent movement within the cylindrical opening 114. The ring sections 110 and 112 are somewhat flexible, even though composed of a metal material such as aluminum, steel, titanium or other suitable metal or non-metal materials. When the screws or other retainer devices are tightened the ring sections 110 and 112 are flexed, thus closing the gap 120 to a certain extent and causing the ring sections to establish a clamping or gripping relation with the barrel of a sighting device to secure it against movement relative to the sight mount ring device 96.

OPERATION

A lever actuated sight mount rail clamp mechanism 26 in the form of a pivot mount, with its locking lever 48 rotated to its unlocked or release position is selectively positioned in assembly with the Picatinny rail or with other sight mount rail of the firearm, with the mount location key 29 engaged within a selected transverse groove or slot of the rail, thus positioning a sighting device 18 as desired relative to the receiver of the firearm. The locking lever is then rotated to its locking position, causing the tapered cam surface 45 of the cam plate 46 to establish clamping engagement with a downwardly facing angulated locking surface 37 of the sight mounting rail 11. This cam actuated clamping activity causes downwardly facing angulated rail surfaces 32 and 34 to be drawn into tight clamping engagement with upwardly facing angulated rail surfaces 33 and 35. The lever and cam actuated clamping activity also causes precise centering of the sight mount rail clamp mechanism 26 on the sight mount rail so that the sighting device 18 is secured at its previously sighted zero position relative to the sight mounting rail and other firearm components. This feature, presented in detail in the disclosure of U.S. Pat. No. 7,272,904 of LaRue, permits firearm users to efficiently remove and replace the sighting devices of a firearm without losing the previously sighted zero. A firearm employing this sight mount clamping mechanism may be transported with one or more sighting devices removed from the firearm and protected in the user's tactical travel pack. This feature is especially important and beneficial when the firearm is being manually transported during tactical maneuvers, especially at night or during inclement weather conditions. When a site of firearm use is reached, the user will simply remove the sight and mount assemblies for the tactical travel pack and lock the sighting devices in place on the rail mounting system of the firearm. The firearm will be ready to sight and fire accurately when the sighting devices are installed in this manner.

Figure 9:
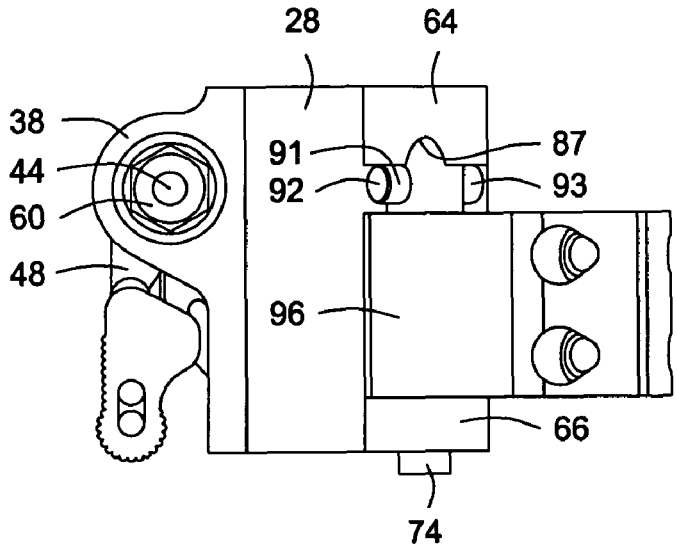
FIG. 9 is a plan view of the pivot mount mechanism of FIGS. 1-4, showing the laterally offset but intermediate position of the sight support device as occurs during pivotal movement of the sight support device between its operative and inoperative positions.
Figure 10:
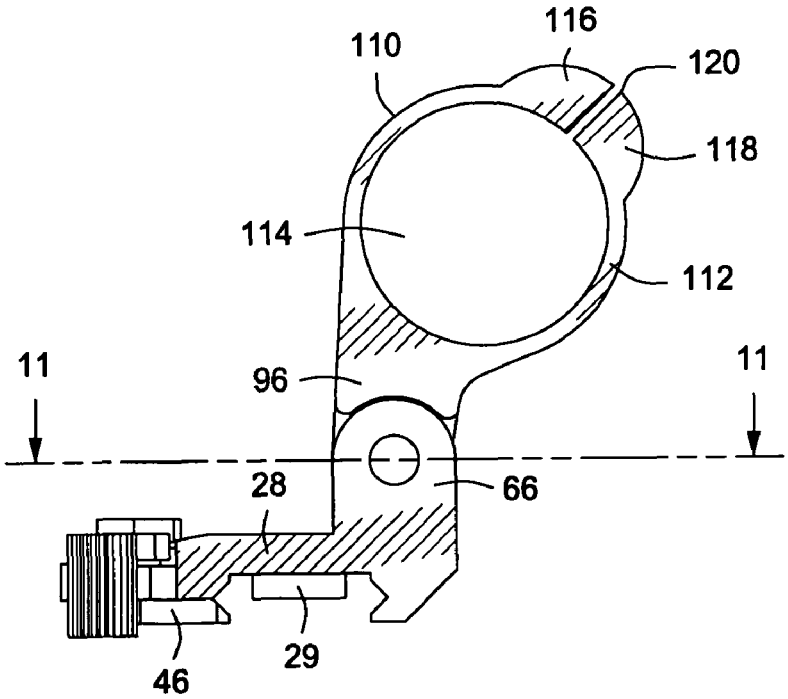
FIG. 10 is an end view of the pivot mount mechanism of FIG. 9, showing the intermediate position of the sight support device.

Assuming that the pivot mount mechanism 26 is located at its operative position as shown in FIGS. 1 and 2, and it is desired to move the sighting device 18 to a laterally offset out of the way position, the user will grasp the sight support device 96 and the sighting device 18 and apply sufficient manual pulling force. When the pulling force is sufficient to overcome the force of the compression spring 80, the pivot mount mechanism will be moved linearly and rearwardly sufficient to extract the ends 91 and 93 of the pivot shaft locator pin 92 from the pivot shaft location receptacles 86 and 88. After this linear retracting movement of the sight mount ring device 96 and the sighting device 18 has been accomplished a manual rotational force is applied to rotate the sight support device 96 and the sighting device 18 toward a laterally offset position. After slight rotational movement of sight mount ring device 96 has occurred the pulling or retracting force can be dissipated, causing the ends 91 and 93 of the pivot shaft locator pin 92 to be in supported engagement with the inner end surface 65 of the upstanding pivot boss 64 as shown in FIGS. 9 and 11. Manual rotation of the sight support device 96 from this position will simply cause the ends of the pivot shaft locator pin 92 to slide along the inner end surface 65

Rotation of the sight support device 96 and the sighting device 18 can be continued until the ends 91 and 93 of the pivot shaft to move into registry with the second pair of generally vertically aligned pivot shaft location receptacles 87-89. At this point the force of the compression spring 80 will drive the pivot shaft toward the pivot boss 64, causing the ends 91 and 93 of the pivot shaft to engage within the second pair of shaft location receptacles 87 and 89 and lock the pivot shaft, sight mount ring device and sighting device against rotation from the laterally offset inoperative position. At this inoperative position the sighting device will be secured against any inadvertent movement and thus will not make any noise when the firearm is moved from one position to another.

Returning the sighting device to its operative position is accomplished simply by applying a pulling or retracting force to the sight support device 96 and the sighting device 18 and rotating the sighting device to its operative position, whereupon the spring force will again seat the ends of the pivot shaft locator pin 92 within the first pair of generally horizontally oriented receptacles 86 and 88.

In view of the foregoing it is evident that the present invention is one well adapted to attain all of the objects and features hereinabove set forth, together with other objects and features which are inherent in the apparatus disclosed herein.

As will be readily apparent to those skilled in the art, the present invention may easily be produced in other specific forms without departing from its spirit or essential characteristics. The present embodiment is, therefore, to be considered as merely illustrative and not restrictive, the scope of the invention being indicated by the claims rather than the foregoing description, and all changes which come within the meaning and range of equivalence of the claims are therefore intended to be embraced therein.

I claim:

1. A pivot mount mechanism for a firearm sighting device, comprising:

a mount base adapted to be secured in substantially fixed relation on a firearm and defining pivot shaft location depressions, said mount base defining spaced sections each defining a pivot shaft bore;

a pivot shaft being supported by said mount base and being rotationally and linearly moveable relative to said mount base and defining pivot shaft location surfaces disposed for pivot shaft rotational positioning engagement with said pivot shaft location depressions, said pivot shaft having end portions pivotally mounted for rotational and linear movement within said pivot shaft bores;

a sight support member being fixed to said pivot shaft and being rotationally and linearly moveable with said pivot shaft and being rotationally and linearly moveable between said spaced sections of said mount base, said sight support member supporting a firearm sighting device;

said pivot shaft being selectively positionable at an operative sighting position with said pivot shaft location depressions permitting precision aiming of the firearm and being selectively rotatably positionable to establish an inoperative laterally offset position of the firearm sighting device; and a pivot shaft locator pin extending from said pivot shaft and having end portions defining pivot shaft location surfaces, said end portions of said pivot shaft locator pin selectively engaging within said location depressions and establishing said operative and inoperative positions of said pivot shaft and sight support member.

2. The pivot mount mechanism of claim 1, wherein a sight mounting rail is present on the firearm, said pivot mount mechanism comprising:

a locking lever actuated clamp mechanism being defined by said mount base and responsive to selective locking lever movement establishing a clamping condition securing said mount base to the sight mounting rail and a release condition permitting separation of said mount base from the sight mounting rail.

3. The pivot mount mechanism of claim 1, comprising:

a spring member applying spring force to said mount base and axial spring force to said pivot shaft urging said pivot shaft toward said pivot shaft location depressions.

4. The pivot mount mechanism of claim 1, comprising:

said mount base defining opposed spaced surfaces defining a space of predetermined dimension therebetween; and said sight support member having a dimension less than said predetermined dimension and being linearly and rotationally moveable within said space between said opposed spaced surfaces.

5. The pivot mount mechanism of claim 1, comprising:

said pivot shaft locator pin being of circular cross-sectional configuration; and said pivot shaft location depressions having pin centering surfaces being engaged by said pivot shaft locator pin and establishing precision rotational positioning said pivot shaft at said operative sighting position.

6. The pivot mount mechanism of claim 1, comprising:

said pivot shaft location depressions being a pair of depressions establishing substantially 90° rotational positioning of said pivot shaft between said operative sighting position and said inoperative laterally offset positions thereof.

7. The pivot mount mechanism of claim 1, comprising:

said mount base defining spaced sections each defining a pivot shaft bore, said pivot shaft location depressions being positioned in substantially 90° rotational relation with one another; and said pivot shaft locator pin extending through said pivot shaft and having end portions disposed for selective engagement within said pivot shaft location depressions and establishing said operative sighting position and said inoperative laterally offset positions of said pivot shaft and said sight support member and the firearm sighting device.

8. A pivot mount mechanism for a sighting device of a firearm, comprising:

a mount base adapted to be secured in substantially fixed relation on a firearm and defining spaced pivot shaft sections each defining a pivot shaft opening, said mount base defining pairs of opposed pivot shaft location depressions having rotational relation of substantially 90';

a pivot shaft and having end portions being supported for rotational and linear movement within said pivot shaft openings of said spaced pivot shaft sections of said mount base;

a pivot pin extending through said pivot shaft and projecting laterally from said pivot shaft and defining pivot shaft location surfaces disposed for rotationally positioning engagement within said pivot shaft location depressions;

a spring member applying spring force to said mount base and to said pivot shaft urging said pivot shaft toward said pivot shaft location depressions;

a sight support member being fixed to said pivot shaft and being rotationally and linearly moveable with said pivot shaft, said sight support member supporting a firearm sighting device; and said pivot shaft being selectively positionable at an operative sighting position in position controlled relationship with said pivot shaft location depressions permitting precision aiming location of the firearm sighting device and being selectively rotatably positionable to establish an inoperative laterally offset position of said sight support member and the firearm sighting device.

9. The pivot mount mechanism of claim 8, comprising:

said mount base having spaced sections defining opposed spaced surfaces having a space of predetermined dimension therebetween; and said sight support member having a dimension less than said space of predetermined dimension and being linearly and rotationally moveable within said space between said opposed spaced surfaces and causing linear and rotational movement of said pivot shaft.

10. The pivot mount mechanism of claim 8, comprising:

said pivot shaft locator pin being of circular cross-sectional configuration; and said location depressions having pin centering surfaces being engaged by said pivot shaft locator pin and establishing precision rotational positioning said pivot shaft at said operative sighting position.

11. The pivot mount mechanism of claim 8, wherein a sight mounting rail is present on the firearm, said pivot mount mechanism comprising:

a locking lever actuated clamp mechanism being present on said mount base and being responsive to selective locking lever movement establishing a clamping condition securing said mount base to the sight mounting rail and establishing a release condition permitting separation of said mount base from the sight mounting rail.

12. A pivot mount mechanism for a sighting device of a firearm, comprising:

a mount base being fixed to a firearm and defining a pivot shaft bore and pivot shaft location surfaces being oriented in substantially 90° rotational relation;

a pivot shaft being supported by said pivot shaft bore for rotational and linear movement relative to said mount base;

a pivot shaft locator element extending from said pivot shaft and being disposed for positioning engagement with said pivot shaft location surface;

a spring member applying spring force to said mount base and to said pivot shaft urging said pivot shaft linearly toward said pivot shaft location surface;

a sight support member being fixed to said pivot shaft and being rotationally and linearly moveable with said pivot shaft, said sight support member supporting a sighting device; and said pivot shaft being selectively positionable at an operative sighting position in positioned engagement with said pivot shaft location surface by said spring force permitting precision aiming of the firearm and being selectively movable linearly against said spring force to a position unseating said pivot shaft location element from said pivot shaft location surface permitting manual rotational positioning of said sight support member to an inoperative position establishing laterally offset inoperative positioning of the sighting device.

13. The pivot mount mechanism of claim 12, comprising:

said pivot mount having opposed spaced surfaces defining a space therebetween; and said sight support member being rotatably and linearly moveable within said space.

14. The pivot mount mechanism of claim 12, comprising:

said at least one pivot shaft location surface being first and second pivot shaft location depressions defined by said mount base and being oriented in substantially 90° rotational relation, said first pivot shaft location depression establishing said operative sighting position of said pivot shaft and said second pivot shaft location depression establishing said inoperative position of said pivot shaft.

15. The pivot mount mechanism of claim 12, wherein a sight mounting rail is present on the firearm, said pivot mount mechanism comprising:

a locking lever actuated clamp mechanism being mounted to said mount base and responsive to selective locking lever movement establishing a clamping condition securing said mount base to the sight mounting rail and a release condition permitting separation of said mount base from the sight mounting rail.

16. A pivot mount mechanism for a sighting device of a firearm, comprising:

a mount base adapted to be secured in substantially fixed relation on a firearm and defining first pivot shaft location surfaces having rotational relation of substantially 90°, said mount base defining spaced sections having a defined spacing therebetween, each of said spaced sections having a pivot shaft bore;

a pivot shaft being supported for rotational and linear movement within said pivot shaft bores;

a pivot shaft locator element extending from said pivot shaft and defining second pivot shaft location surfaces disposed for rotationally positioning engagement with said first pivot shaft location surfaces;

a sight support member being fixed to said pivot shaft and having less dimension than said predetermined dimension and being rotationally and linearly moveable with said pivot shaft and within said defined spacing between said spaced sections, said sight support member supporting a sighting device;

a spring member applying spring force to said mount base and to said pivot shaft and sight support member urging said pivot shaft and sight support member toward positioning engagement of said second pivot shaft location surfaces with said second pivot shaft location surfaces; and upon linear movement of said sight support member within said defined space and separation of said pivot shaft locator element from said first pivot shaft location surfaces said pivot shaft and said sight support member being selectively rotationally positionable at an operative sighting position in positioning engagement with said first pivot shaft location surfaces permitting precision aiming of the firearm and being selectively rotationally positionable to establish an inoperative laterally offset position of the sighting device.

* * * * *